US008806912B2

(12) United States Patent
Chiesa et al.

(10) Patent No.: US 8,806,912 B2
(45) Date of Patent: Aug. 19, 2014

(54) POWDER METAL FORGING AND METHOD AND APPARATUS OF MANUFACTURE

(75) Inventors: Alfred J. Chiesa, Farmington Hills, MI (US); Hank J. Knott, Ypsilanti, MI (US); David E. Lenhart, Jr., Pomeroy, OH (US); Branko Cvetkovic, Ontario (CA)

(73) Assignee: GKN Sinter Metals, LLC, Auburn Hills, MI (US)

( * ) Notice: Subject to any disclaimer, the term of this patent is extended or adjusted under 35 U.S.C. 154(b) by 1468 days.

(21) Appl. No.: 12/517,606

(22) PCT Filed: Dec. 12, 2007

(86) PCT No.: PCT/US2007/087149

§ 371 (c)(1),
(2), (4) Date: Sep. 22, 2010

(87) PCT Pub. No.: WO2008/073952

PCT Pub. Date: Jun. 19, 2008

(65) Prior Publication Data

US 2011/0000335 A1 Jan. 6, 2011

Related U.S. Application Data

(60) Provisional application No. 60/869,659, filed on Dec. 12, 2006.

(51) Int. Cl.
*B21D 22/00* (2006.01)

(52) U.S. Cl.
USPC ..... 72/352; 72/353.2; 72/359

(58) Field of Classification Search
USPC ..... 72/352, 353.2, 353.6, 354.2, 354.6, 72/358, 359, 467; 29/893.34
See application file for complete search history.

(56) References Cited

U.S. PATENT DOCUMENTS

| | | | |
|---|---|---|---|
| 3,694,127 | A | 9/1972 | Takahashi et al. |
| 3,842,646 | A | 10/1974 | Kuhn |
| 4,038,860 | A | 8/1977 | Kanamaru et al. |

(Continued)

FOREIGN PATENT DOCUMENTS

| | | |
|---|---|---|
| GB | 618009 | 2/1949 |
| JP | 06-142815 | 5/1994 |

(Continued)

OTHER PUBLICATIONS

Notice of the First Office action in the Peoples Republic of China, mailed Aug. 30, 2010, 8 pages.

(Continued)

*Primary Examiner* — Edward Tolan
(74) *Attorney, Agent, or Firm* — Quarles & Brady LLP

(57) ABSTRACT

A method and apparatus for forming a powder metal forging (B) includes a die set (A1D) for forming the powder metal forging (B) having a first die (A) complementary with a second die (D) in a longitudinal direction (ZC). The die set (A,D) has at least two features (10) of dimensions with a longitudinal component (10) and a lateral component (18), and at least the lateral component (18) varies along the longitudinal direction (ZC), at least one such feature (10) in each die (A,D). Each of the first die (A) and the second die (D) includes a castellated parting interface (12,13) dissecting the laterally varying internal longitudinal feature (10, 18) in the first die from the laterally varying feature (10, 18) in the second die (D). The castellation (12,13) in the dies (A,D) provides forged powder metal parts (B) with features of opposite drafts without trapping the part (B) in the dies (A,D).

9 Claims, 7 Drawing Sheets

(56) References Cited

U.S. PATENT DOCUMENTS

| | | | | |
|---|---|---|---|---|
| 4,051,590 | A | 10/1977 | Halter et al. | |
| 4,165,243 | A | 8/1979 | Sarnes et al. | |
| 4,712,411 | A | 12/1987 | Goodwin | |
| 5,221,233 | A | 6/1993 | Jacob | |
| 5,242,329 | A * | 9/1993 | Jacob | 464/145 |
| 5,718,774 | A | 2/1998 | Tukamoto et al. | |
| 6,044,684 | A * | 4/2000 | Ohama et al. | 72/354.2 |
| 6,630,101 | B2 | 10/2003 | Anderson et al. | |
| 6,730,263 | B2 | 5/2004 | Ernst et al. | |
| 6,796,906 | B2 | 9/2004 | Cermak | |
| 6,877,350 | B2 * | 4/2005 | Fuhrmann et al. | 72/354.2 |
| 7,967,685 | B2 * | 6/2011 | Suzuki | 464/145 |
| 2003/0049151 | A1 | 3/2003 | Wehler | |
| 2007/0221005 | A1 | 9/2007 | Geiman | |
| 2010/0035077 | A1 | 2/2010 | Chiesa | |
| 2010/0083782 | A1 | 4/2010 | Chiesa | |

FOREIGN PATENT DOCUMENTS

| | | | | |
|---|---|---|---|---|
| JP | 2001-334342 A * | 12/2001 | | B21K 1/14 |
| JP | 2002-1476 A * | 1/2002 | | B21J 13/02 |
| JP | 2005-199338 A | 7/2005 | | |
| JP | 2004010769 | 7/2005 | | |
| JP | 2008-89112 A * | 4/2008 | | F16D 3/20 |
| WO | PCT/US2010/060066 | 2/2011 | | |

OTHER PUBLICATIONS

PCT International Search Report for PCT/US2010/060066, mailed Feb. 11, 2011.

PCT International Search Report for PCT/US08/53389 mailed Jun. 5, 2008.

PCT International Search Report for PCT/US08/58980 mailed Aug. 21, 2008.

International Search Report and Written Opinion as mailed on Aug. 19, 2008 for International Patent Application PCT/US2007/87149.

Translation of Office action entitled "Notification of Reason(s) for Refusal" for corresponding Japanese Patent Application No. 2009-541541; mailed Aug. 21, 2012; 3 pages.

* cited by examiner

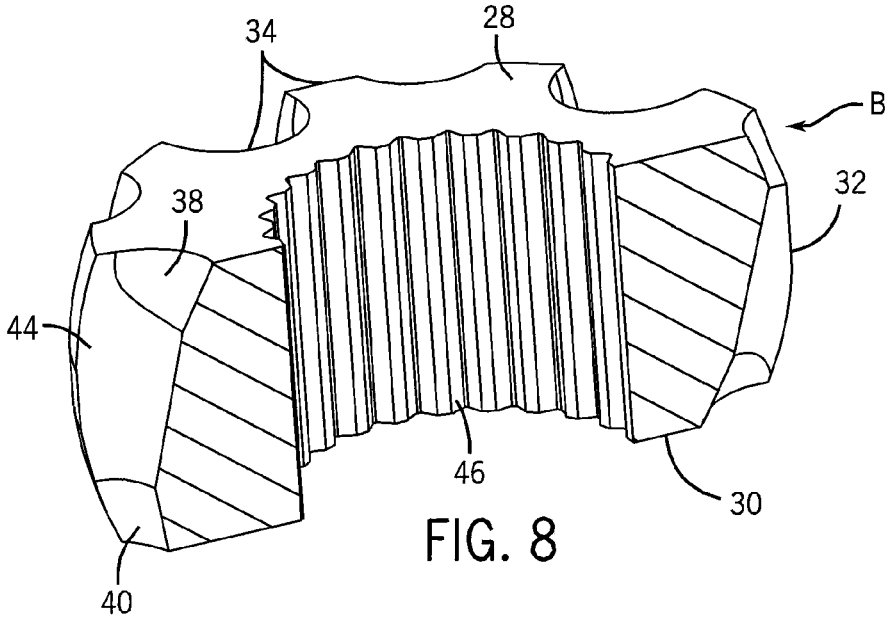
FIG. 8
FIG. 9
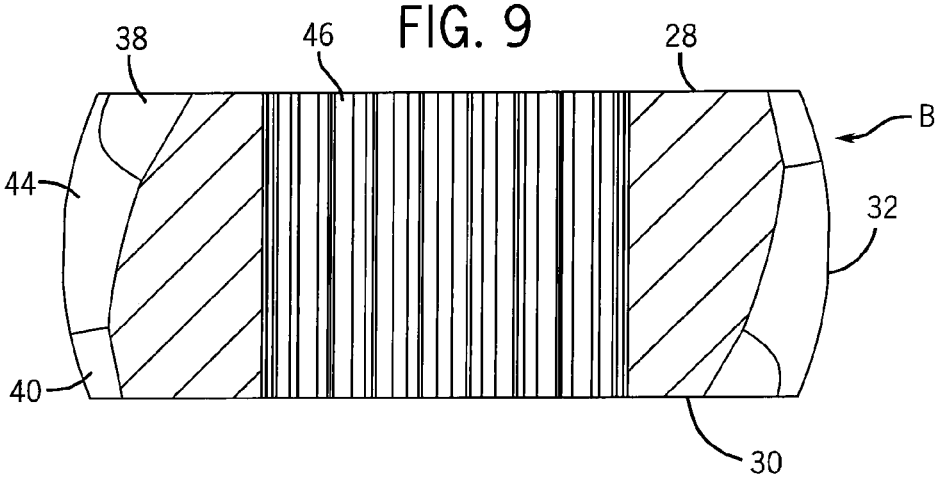

POWDER METAL FORGING AND METHOD AND APPARATUS OF MANUFACTURE

CROSS-REFERENCE TO RELATED APPLICATION

This claims the benefit of U.S. Provisional Patent Application No. 60/869,659 filed Dec. 12, 2006, which is hereby incorporated by reference.

STATEMENT CONCERNING FEDERALLY SPONSORED RESEARCH OR DEVELOPMENT

Not applicable.

FIELD OF THE INVENTION

The present invention relates to powder metal forgings, and, more particularly, relates to powder metal forgings with lateral flow during the forging process.

BACKGROUND OF THE INVENTION

In the manufacture of powder metal forgings, such as an inner race of a constant velocity joint (CVJ), it is sometimes desirable to provide a through-hardened part directly from the forge press. This requires that the part be directly quenched after the part has been ejected from the forge tooling. In forging such a part, the upper die moves in a downward direction to the lower die to deform the billet, which forms the part. This results in flash forming on the sides of the part where the upper and lower dies meet, which is in an area of bearing races for an inner race of a CVJ. If the part is directly quenched, then the tool flash is in a hardened state. Although hard trimming, which is a method of shearing the flash from the part, is possible, it is not practical because the flash can exceed the hardness of the current trim creating a potentially dangerous situation for the operators and can also negatively impact the quality of the product. That is, the part can break apart during trimming and fly out of the confines of the tooling. Also, the bearing races are precision surfaces and fairly intricate so that they are not very amenable in general to shearing.

A method of forging a CVJ inner race is known whereby a segmented die (6 die segments) is used to form the CVJ inner race using a traditional cold forging technique. However, this technique requires a machine broach and a relatively long carburization process. Further, there are six vertical witness lines on the part corresponding to the six die segments. Other disadvantages of this method are that it is a relatively complex and expensive tooling arrangement, with a relatively short die life.

Additionally, CVJs are known which have alternating, or counter, ball-tracks, where shallow ends and deep ends of the tracks alternate position, i.e., which end they're at, on every other track. See for example U.S. Pat. No. 5,221,233. Such designs may be used in a constant velocity fixed joint for large articulation angles and a high torque capacity. One method of fabricating such devices is to use segmented dies, as described above, to be separated after the forging process. This adds complexity to the process, slower cycle times, and contamination of the sealing surfaces in a hot forging environment due to the die lubricants. Further, this process is used in cold forging processes to make CVJs.

In an inner race of a CVJ, with alternating ball tracks, shallow end and deep end of the ball tracks alternate every other track, and therefore the formed inner race has a lateral flow of material in the forging process. The process described above, wherein the upper die moves in a downward direction to the lower die to deform the billet, in addition to having flash forming on the sides of the part where the upper and lower dies meet, will not allow the die-set to separate after the part is formed due to the lateral flow of material during forging. It is possible to machine the CVJ with the alternating ball tracks out of bar-stock, or out of a powder metal part that does not have counter ball tracks, although this is expensive and material inefficient.

What is needed in the art is a design and process that gives a near-net shaped alternating ball race CVJ, or other powder metal parts which include lateral flow during the forging process, without sacrificing cycle time and maintaining a relative simplicity to the tool set.

SUMMARY OF THE INVENTION

The present invention provides a design and process that provides a near-net shaped alternating ball race CVJ, or other powder metal part that includes lateral flow during the forging process, without sacrificing cycle time and maintaining a relative simplicity to the tool set.

Additionally, the present invention provides a powder metal forging and method and apparatus of manufacture which includes a closed die set, and also the powder metal preform, where the preform is forged in the closed die set to produce a minimum flash or flash-free/precision flash powder metal forging.

The invention comprises, in one form thereof, a die set for forming a powder metal forging, which includes a first die that interfits with a second die in a longitudinal direction. The die set has at least one laterally varying internal longitudinal feature extending in the longitudinal direction from the first die to the second die. Each of the first die and the second die includes a castellated parting interface dissecting each laterally varying internal longitudinal feature into a first element in the first die and a second element in the second die.

The invention comprises, in another form thereof, a die set for forming a powder metal forging that includes a first die complementary with a second die in a longitudinal direction. The die set has at least one internal longitudinal feature extending in the longitudinal direction from the first die to the second die. At least one internal longitudinal feature has a lateral component that varies along the longitudinal direction.

The invention comprises, in yet another form thereof, a castellated die set which includes a first die having a longitudinal direction and a first die mating contour with a first plurality of die mating surfaces transverse to the longitudinal direction. The first plurality of die mating surfaces includes at least a first surface and a second surface. The first surface is in a first position in the longitudinal direction, and the second surface is in a second position in the longitudinal direction. The first position is offset from the second position in the longitudinal direction. A second die has a second die mating contour with a second plurality of die mating surfaces transverse to the longitudinal direction. The second plurality of die mating surfaces includes at least a third surface and a fourth surface, where the third surface is in a third position complimentary to the first position, and the fourth surface is in a fourth position complimentary to the second position.

The invention comprises, in another form, a method of making a powder metal forging which includes the steps of: providing a castellated die set having a first die that mates with a second die in a longitudinal direction, the die set having at least one laterally varying internal longitudinal feature extending in the longitudinal direction from the first die to the second die, each of the first die and the second die including a castellated parting interface dissecting each laterally varying internal longitudinal feature into a first element in the first die and a second element in the second die; inserting a preform in the first die; closing the die set by contacting the first die against the second die; and compressing a punch against the preform, the compressing step following the closing step and converting the preform to the powder metal forging.

In another aspect the invention comprises a powder metal forging that includes a first end, a second end opposed to the first end, and an outer contour that connects the first end and the second end. The outer contour has at least one external longitudinal feature. The outer contour also includes a castellated parting line that dissects at least one external longitudinal feature into a first component extending from the castellated parting line towards the first end, and a second component extending from the castellated parting line towards the second end.

In another aspect, the invention provides a powder metal forging that includes a first end, a second end opposed to the first end, and an outer contour connecting the first end and the second end. The outer contour includes a plurality of longitudinal projections and a plurality of longitudinal depressions. Each of the plurality of longitudinal projections are separated from another of the plurality of longitudinal projections by a corresponding one of the plurality of longitudinal depressions. The outer contour includes a castellated parting line dissecting the plurality of longitudinal projections and the plurality of longitudinal depressions.

The invention provides a design and process that gives a near-net shaped alternating ball race CVJ, or other powder metal parts that include lateral flow during the forging process, without sacrificing cycle time and maintaining a relative simplicity to the tool set. The invention provides an opportunity to reduce the manufacturing cycle time, overall cost of the manufactured part, and the complexity of the tooling needed to form the part. It can be used in a powder forging process with shorter cycle-time than is required in a cold forging process and requires minimal stock removal. The invention helps minimize the time the part is in contact with the tooling, thereby also reducing tooling costs.

The invention can also be used to forge an internal spline if desired in the forged part. In addition, the preform can be formed so that there is little or no buckling of the preform in the forging operation; particularly with longitudinal splines on an inside diameter of the preform.

The invention can also be applied to provide a minimum flash or a flash-free/precision flash powder metal forging. The invention can be applied so that there is little or no material overlapping or folding during the forging operation, and can be used with a preform of relatively high density. A forging made with the invention can be direct quenched, by oil submersion for example, immediately after the forging process.

The invention can be applied to provide a cost effective way of manufacturing an inner race of a constant velocity joint, with alternating ball races. The invention could also be applied to manufacture other complex parts taking advantage of some or all of the advantages of the invention.

The foregoing and other features and advantages of the invention will be apparent from the detailed description which follows and drawings. In the description, reference is made to the accompanying drawings which illustrate a preferred embodiment of the invention.

BRIEF DESCRIPTION OF THE DRAWINGS

FIG. 8 is perspective cross-sectional view of the CVJ inner race of FIG. 6;

FIG. 9 is a cross-sectional view of the CVJ inner race of FIG. 6;

DETAILED DESCRIPTION OF THE PREFERRED EMBODIMENT

Figure 1C:
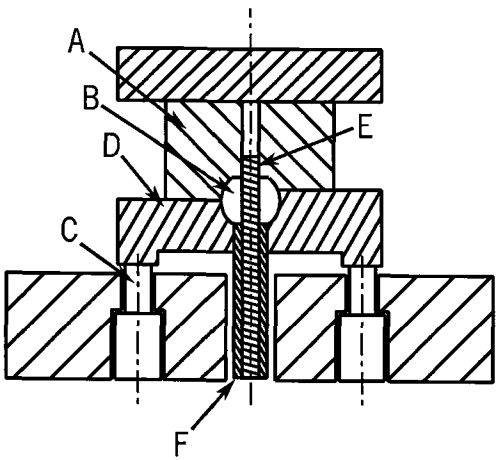
FIGS. 1A-1F are a series of cross-sectional schematic views illustrating an embodiment of the method and apparatus according to the present invention.
Figure 1B:
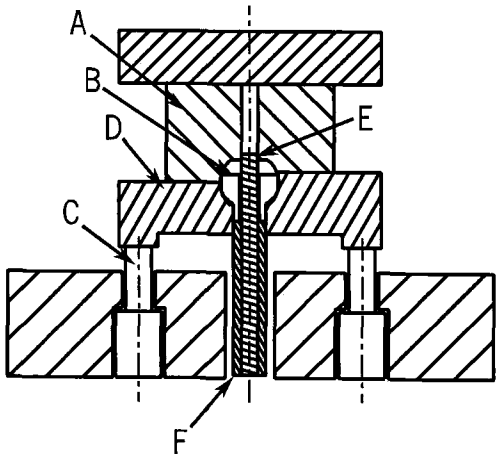
Figure 1A:
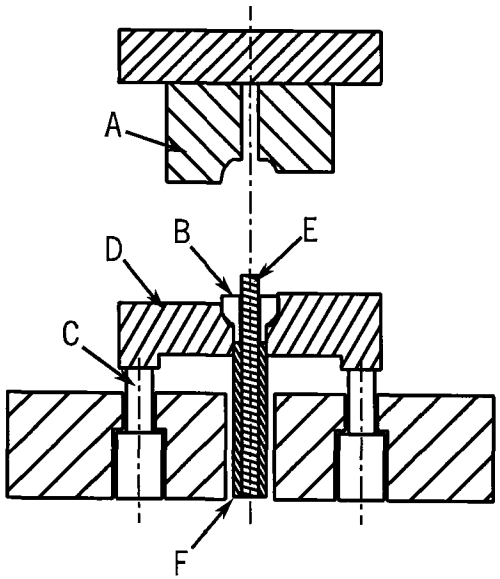

Referring now to the drawings, and more particularly to FIGS. 1A-6, there is shown a method and apparatus of forming a powder metal forging B, where in FIG. 1A preform B is loaded into the die cavity with core rod E inserted through it, and in which the preform and the core rod E may define splines or another shape that is used for a driving connection between two shafts or a shaft and a hub. The upper die A moves down to contact the lower die D in FIG. 1B. Dies A and D comprise a die set. There is sufficient force on cylinders C to keep the upper and lower dies A and D in contact through the entire forging process. No forging is done at this point (FIGS. 1A-1B) in the press cycle. In FIG. 1C, the upper die A continues down forcing the lower die D, and compressing cylinders C, down to the face of the lower punch F to forge part B to its final forged size and shape. During this step, the lower part of the preform gets pushed up into the upper part by the lower punch F, effectively shortening the preform longitudinally and filling the die cavity longitudinally and laterally, to create the final forged size and shape.

Figure 1F:
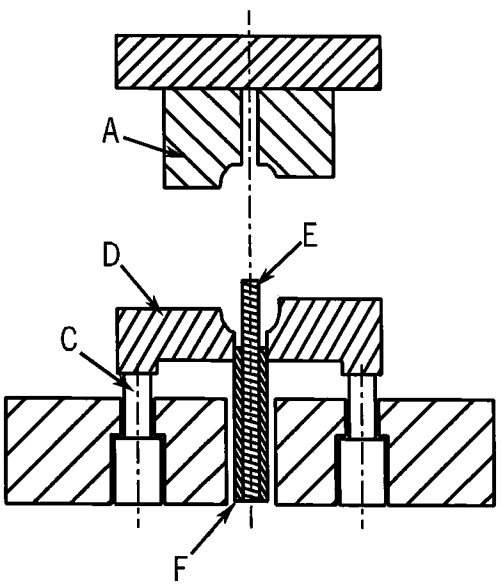
Figure 1E:
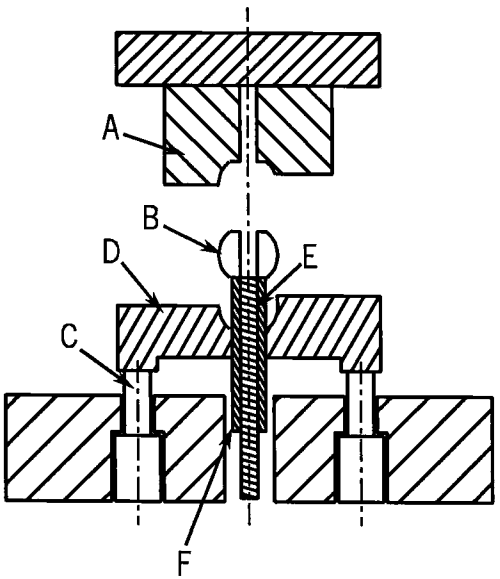
Figure 1D:
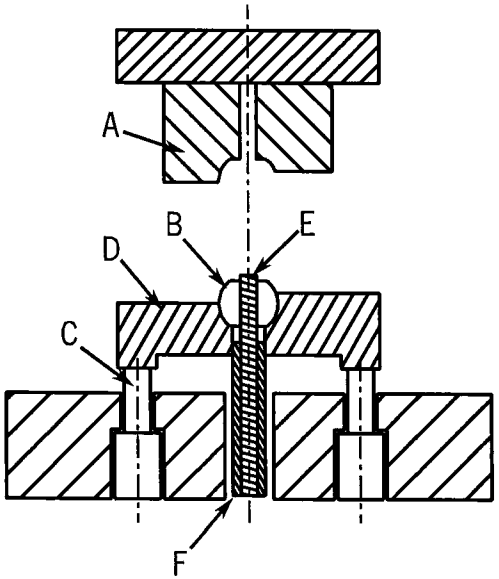
Figure 2:
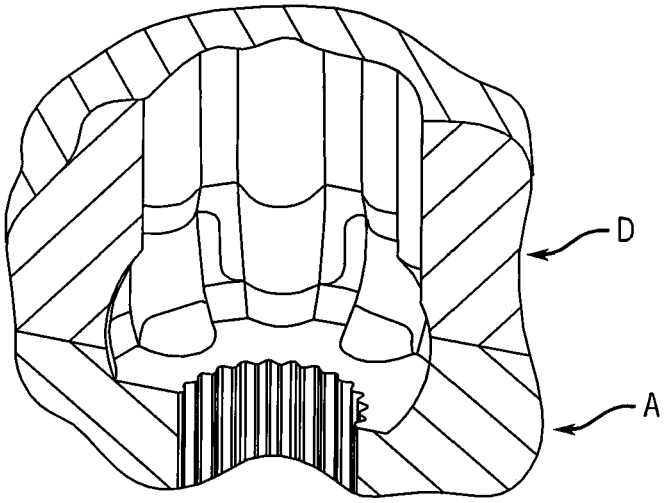
FIG. 2 is a cross-sectional perspective view of the die set of FIGS. 1A-1F.
Figure 3:
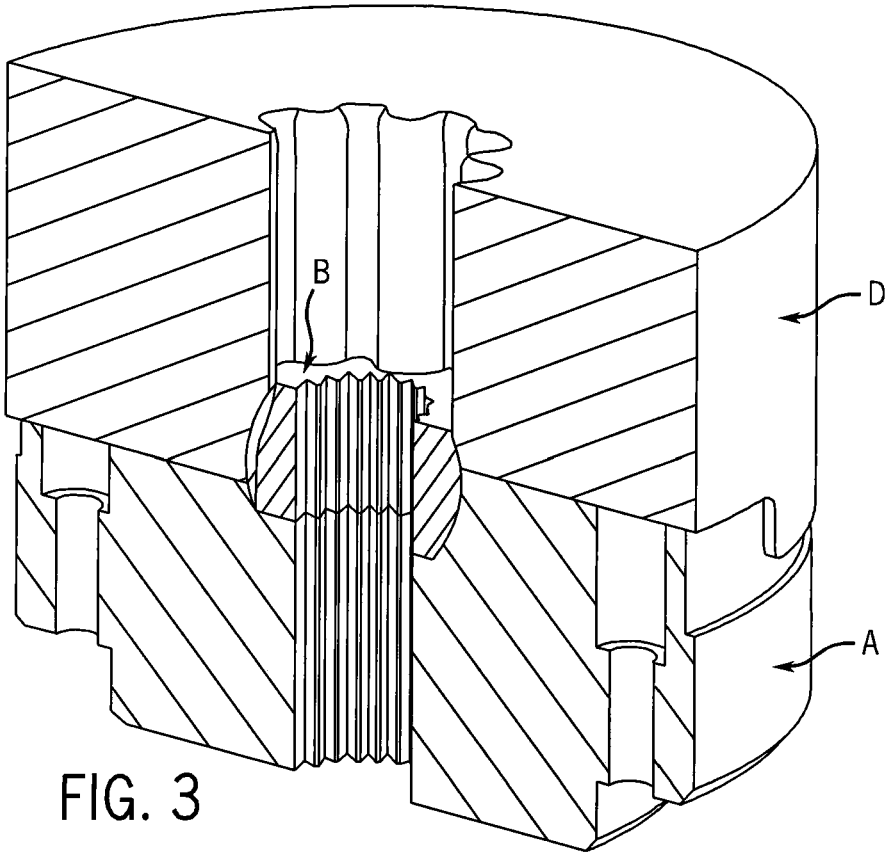
FIG. 3 is a cross-sectional perspective view of the die set of FIG. 2, with a powder metal preform inserted therein.

In FIG. 1D, the upper die A moves to its uppermost position, and lower die D moves to its upper most position being driven by cylinders C, and the part is partially ejected off of core rod E and lifted from lower punch F as illustrated. The ejection timing can be adjusted to eliminate the amount of gap between the bottom of the forged part B and the top face of the lower punch F. In FIG. 1E, the lower punch F moves up to finish ejecting the forged part B out of lower die D, and off of core rod E. The forged part B can be taken out of the press by any suitable means, usually automated (not shown). In FIG. 1F, lower punch D moves down to the press position and the first complete press cycle is complete.

Figure 4:
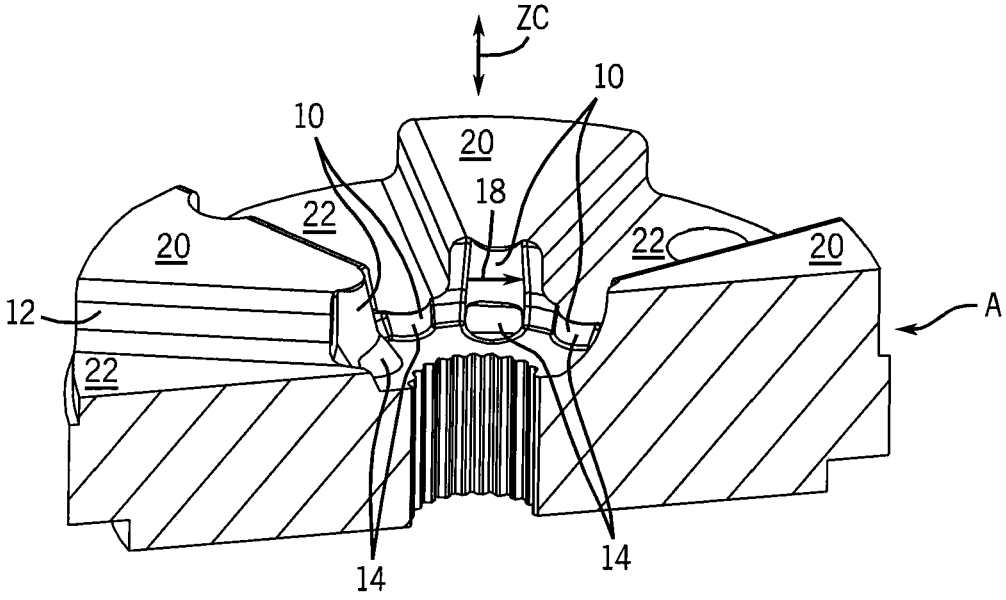
FIG. 4 is a fragmentary cross-sectional perspective view of the castellated upper die of FIG. 1.
Figure 5:
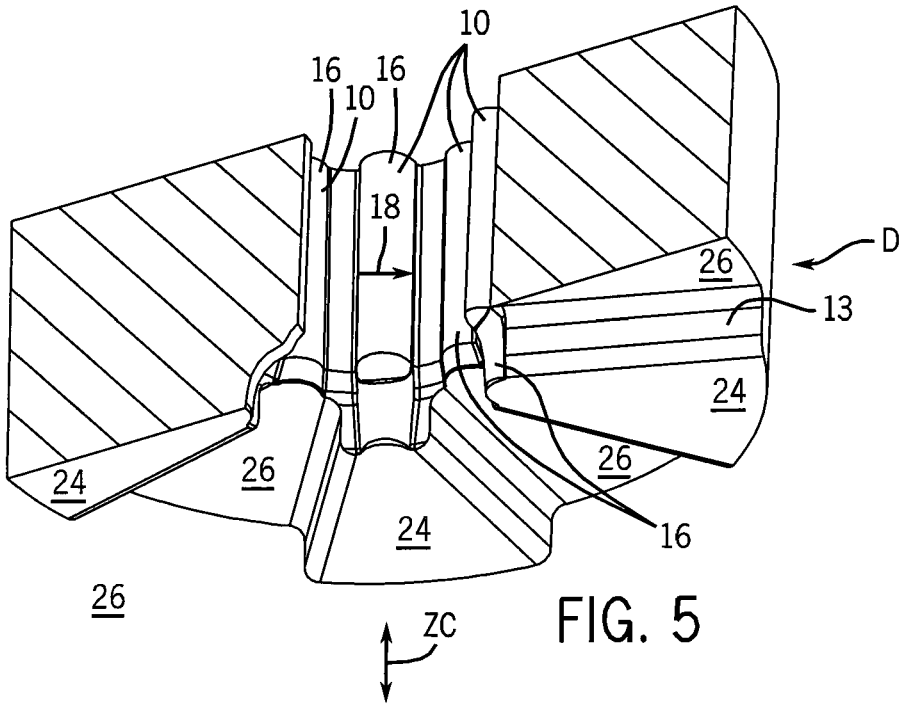
FIG. 5 is a fragmentary cross-sectional perspective view of the castellated lower die of FIG. 1.

Referring more particularly to FIGS. 4-7, a castellated die set A, D for forming a powder metal forging B (forged) includes first die A mateable with second die D in a longitudinal direction ZC. The die set has at least one laterally varying internal longitudinal feature 10 extending in longitudinal direction ZC from first die A to second die D. First die A and second die D include castellated parting interfaces 12, 13, respectively, dissecting each laterally varying internal longitudinal feature 10 into a first element 14 in first die A and a second element 16 in second die D. The castellated parting interface 12 can be approximately in a form of a square wave, as shown in FIGS. 4 and 5, or alternatively can have other shapes such as sinusoidal or a more random castellation depending on the configuration of features 10.

The internal longitudinal feature 10 includes an extent 18 transverse to longitudinal direction ZC and which extends along longitudinal direction ZC. At least one extent 18 expands and/or contracts in longitudinal direction ZC. This die structure produces the alternating ball races, shown particularly in FIGS. 6 and 7, where shallow end and deep end alternate position on every other track. In other words, all of the ball races vary in lateral extent, and adjacent ball races vary oppositely in lateral extent; in one longitudinal direction one gets laterally wider and the adjacent one gets laterally narrower. In this situation, two dies separated on a single horizontal plane could not open after forging the part as the dies would be wedged in the part; whereas the novel castellated die set of the present invention can be used to forge a powder metal inner race of a CVJ or other part which has alternating, or otherwise oppositely varying in lateral component ball races as shown or other features with dimensions having longitudinal components and laterally varying components, or other powder metal parts which include lateral flow into spaces that taper in opposite directions, i.e., in one longitudinal direction some of the spaces get laterally smaller and others of the spaces get laterally larger during the forging process.

First die mating contour 12 includes a first plurality of die mating surfaces 20, 22 transverse to the longitudinal direction, where the first plurality of die mating surfaces include at least a first surface 20 and a second surface 22. First surface 20 is in a first position in the longitudinal direction ZC, and second surface 22 is in a second position in longitudinal direction ZC, where the first position is offset from the second position in the longitudinal direction.

Similarly, second die D has a second die mating contour 13 with a second plurality of die mating surfaces 24, 26 transverse to the longitudinal direction. Third surface 24 is in a third position complimentary to the first position of surface 20, and fourth surface 26 is in a fourth position complimentary to the second position of surface 22.

The surfaces 20, 22 and 24, 26 can alternate in a periodic fashion as shown which creates the castellated parting interfaces 12, 13. Surfaces 20, 22 and 24, 26 can be approximately perpendicular to the longitudinal direction, although this is not necessary. The die parting surfaces dissect the laterally varying internal longitudinal features 10 of the die at a point such that the features 10 do not laterally decrease in dimension in the direction from the parting interfaces 12, 13 to the longitudinal ends of a respective die, in other words they either remain constant or become larger laterally in that direction, which thereby inhibits the dies A, D from being wedged in the forged part when the part is ejected.

Figure 6:
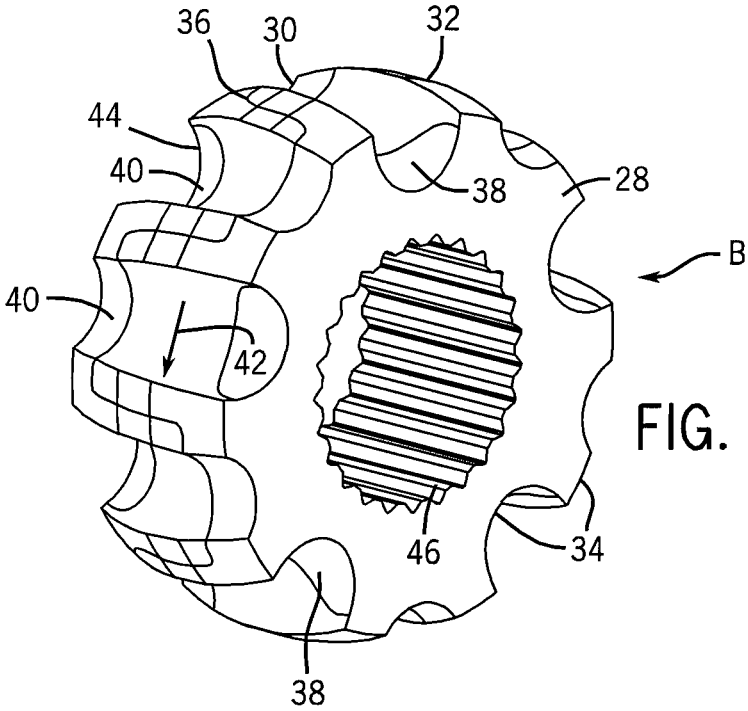
FIG. 6 is a perspective view of a CVJ inner race having alternating ball races according to the present invention.
Figure 7:
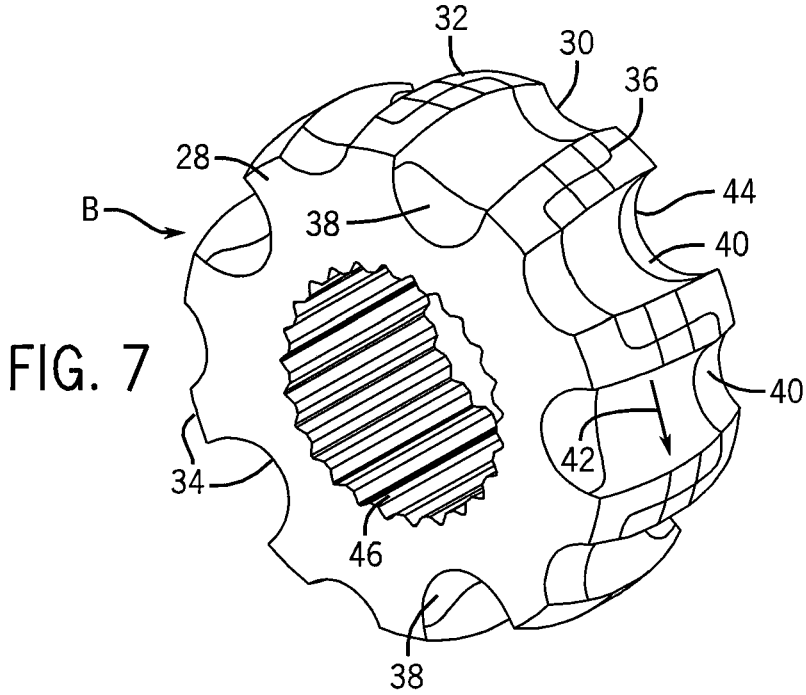
FIG. 7 is another perspective view of the CVJ inner race of FIG. 6.

Referring to FIGS. 6-9, and more particularly to FIG. 6, the powder metal forging B includes a first end 28, a second end 30 opposed to first end 28, and an outer contour 32 connecting first end 28 and second end 30. Outer contour 32 has at least one external longitudinal feature 34, and a castellated parting line 36 which dissects each feature 34 into a first component 38 which extends from castellated parting line 36 towards first end 28, and a second component 40 extending from castellated parting line 36 towards second end 30.

Each first component 38 includes a first lateral extent 42 which is non-decreasing from castellated parting line 36 to first end 28. Second component 40 includes a second lateral extent 44 which is non-decreasing from castellated parting line 36 to second end 30. By lateral direction is meant any direction that is not parallel to the longitudinal direction, the longitudinal direction being the direction along the axis through the hole in the part, which in this case is also the direction of die opening and closing. Castellated parting interface 36 can be approximately in a form of a square wave as shown; however, many other shapes are possible, depending on the configuration of the longitudinal features, and dies A, D. Powder metal forging B can be an inner race of a constant velocity joint, as shown, with a minimum of flash along castellated parting line 36, as dies A, D are closed before the forging begins. Any flash along line 36, line 36 being shown in FIGS. 6 and 7, may be removed by post-forging processing, so in the final part B no line 36 would be visible. Powder metal forging B can include internal splines 46, in which case core rod E would be splined.

Figure 10:
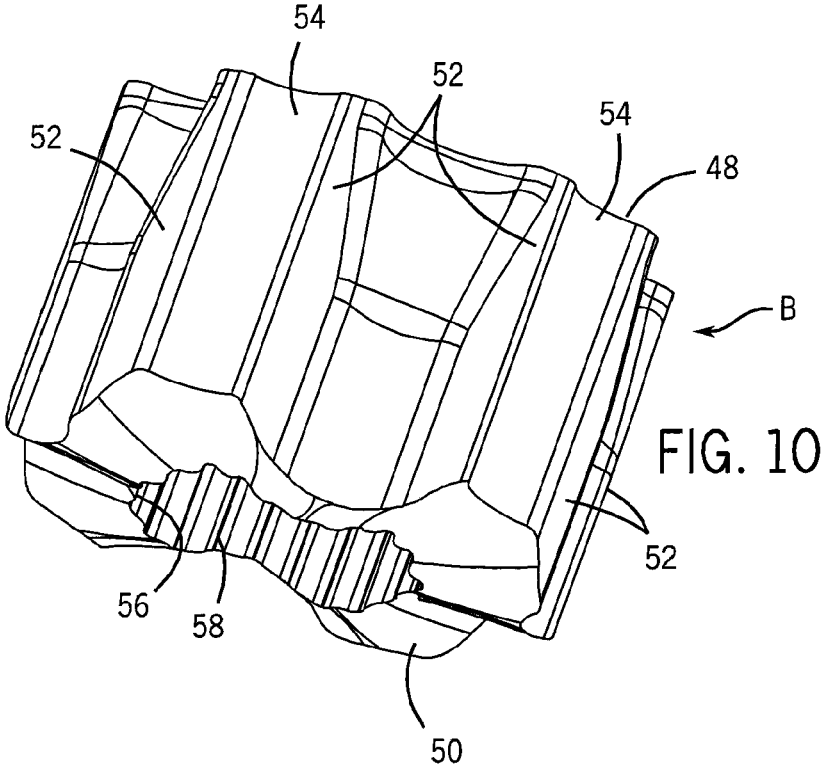
FIG. 10 is a perspective view of the powder metal preform of FIGS. 1 and 3.
Figure 11:
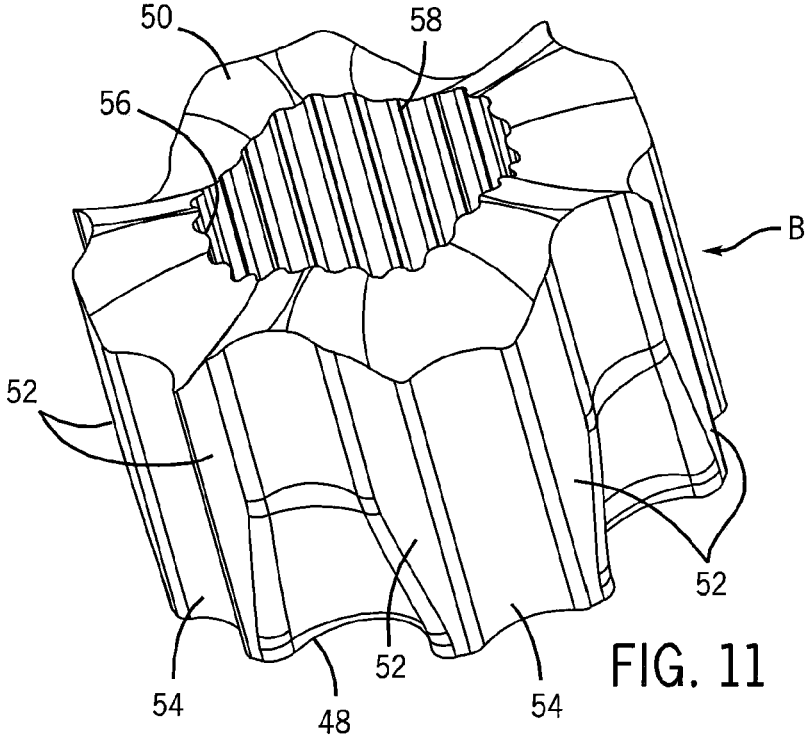
FIG. 11 is another perspective view of a powder metal preform of FIGS. 1 and 3.

Referring more particularly to FIGS. 10 and 11, the preform B includes a powder metal composition which has been compacted and then sintered. For example, the composition of the powder metal may include approximately between 0.40% and 2.00% of Ni, approximately between 0.50% and 0.65% of Mo, approximately between 0.10% and 0.35% of Mn and approximately between 0.0% and 1.20% of C, and the remainder iron (percentages by weight). Preform B is a non-cylindrical preform which includes a first end 48, a second end 50 opposed to first end 48 and an outer contour 52 connecting first end 48 and second end 50. Outer contour 52 includes a plurality of longitudinal projections 52 and a plurality of longitudinal depressions 54. Each of the longitudinal projections 52 are separated from another projection 52 by a corresponding longitudinal depression 54. An inner contour 56 connects first end 48 and second end 50, where inner contour 56 has a plurality of longitudinal splines 58. Splines 58 provide strength to preform B, particularly during the forging process, which keeps the preform from buckling during forging. It can be advantageous for the preform to be of a relatively high density as this yields better properties in the forged part, although generally as the density of the material goes up the flowability goes down. Consequently of this additional strength added by longitudinal splines 58, preform B advantageously can have a density approximately in a range of 6.0 g/cm$^3$ to 8.0 g/cm$^3$, and more particularly, a density in a range of approximately 6.85 g/cm$^3$ to 7.55 g/cm$^3$. Inner contour can also include a keyway (not shown) which can aid in the orientation of the preform when inserting it into the dies.

A preferred embodiment of the invention has been described in considerable detail. Many modifications and variations to the preferred embodiment described will be apparent to a person of ordinary skill in the art. Therefore, the invention should not be limited to the embodiment described.

We claim:

1. A castellated die set for forming a powder metal forging that is a constant velocity joint inner race having alternating ball races, comprising: a first die mateable with a second die in a longitudinal direction, said die set having at least one laterally varying internal longitudinal feature extending in said longitudinal direction from said first die to said second die, the feature in the first die varying oppositely to the feature in the second die, each of said first die and said second die including a castellated parting interface dissecting each said laterally varying internal longitudinal feature, the parting interface of said first die mating with the parting interface of the second die wherein the alternating ball races are tracks in which shallow ends and deep ends alternate position on every other track, wherein the first die and the second die have die mating surfaces transverse to the longitudinal direction, and wherein, for each of the first die and the second die, the positions of the die mating surfaces corresponding to the adjacent tracks are offset in the longitudinal direction.

2. The die set of claim 1, wherein each said castellated parting interface is approximately in a form of a square wave.

3. A die set for forming a powder metal forging that is a constant velocity joint inner race having alternating ball races, comprising: a first die mateable with a second die in a longitudinal direction, each said die having an element of at least one internal longitudinal feature extending in said longitudinal direction that varies in lateral extent wherein the alternating ball races are tracks in which shallow ends and deep ends alternate position on every other track, wherein the first die and the second die have die mating surfaces transverse to the longitudinal direction, and wherein, for each of the first die and the second die, the positions of the die mating surfaces corresponding to the adjacent tracks are offset in the longitudinal direction.

4. A castellated die set for forming a constant velocity joint inner race having alternating ball races, comprising:

a first die having a longitudinal direction and a first die mating contour with a first plurality of die mating surfaces transverse to said longitudinal direction, said first plurality of die mating surfaces including at least a first surface and a second surface, said first surface being in a first position in said longitudinal direction, said second surface being in a second position in said longitudinal direction, said first position being offset from said second position in said longitudinal direction;

a second die having a second die mating contour with a second plurality of die mating surfaces transverse to said longitudinal direction, said second plurality of die mating surfaces including at least a third surface and a fourth surface, said third surface being in a third position complimentary to said first position, said fourth surface being in a fourth position complimentary to said second position; and wherein said first surface, said second surface, said third surface, and said fourth surface are adapted to create castellated parting interfaces and wherein each die has a feature with a longitudinal component and a lateral component, the lateral component varies in dimension and the direction that the lateral component varies in dimension in one die is opposite from the direction that the lateral component varies in the other die, wherein the alternating ball races are tracks in which shallow ends and deep ends alternate position on every other track, and wherein, for each of the first die and the second die, the positions of the first and second plurality of die mating surfaces corresponding to the adjacent tracks are offset in the longitudinal direction.

5. The castellated die set of claim 4, wherein said first plurality of die mating surfaces includes a first plurality of alternating said first surface and said second surface pairs.

6. The castellated die set of claim 5, wherein said second plurality of die mating surfaces includes a second plurality of alternating said third surface and said fourth surface pairs, said second plurality of alternating pairs complementary with said first plurality of alternating pairs.

7. A method of making a powder metal forging that is a constant velocity joint inner race having alternating ball races, comprising the steps of:

providing a castellated die set including a first die mateable with a second die in a longitudinal direction, said die set having at least one laterally varying internal longitudinal feature extending in said longitudinal direction from said first die to said second die, each of said first die and said second die including a castellated parting interface dissecting each said laterally varying internal longitudinal feature into a first element in said first die and a second element in said second die;

inserting a preform in said first die;

closing said die set by contacting said first die against said second die; and compressing a punch against said preform, said compressing step following said closing step and converting said preform to said powder metal forging;

wherein the alternating ball races are tracks in which shallow ends and deep ends alternate position on every other track, wherein the first die and the second die have die mating surfaces transverse to the longitudinal direction, and wherein, for each of the first die and the second die, the positions of the die mating surfaces corresponding to the adjacent tracks are offset in the longitudinal direction.

8. The method of claim 7, further including the step of releasing said first die from said second die.

9. The method of claim 8, further including the step of ejecting said powder metal forging from said die set.

* * * * *